US008490529B2

(12) United States Patent
Meissner et al.

(10) Patent No.: US 8,490,529 B2
(45) Date of Patent: Jul. 23, 2013

(54) PUNCH FOR A ROTARY PRESS

(75) Inventors: Friedrich Meissner, Hamburg (DE); Daniel Malick, Leezen (DE)

(73) Assignee: Fette GmbH, Schwarzenbek (DE)

( * ) Notice: Subject to any disclaimer, the term of this patent is extended or adjusted under 35 U.S.C. 154(b) by 605 days.

(21) Appl. No.: 12/604,593

(22) Filed: Oct. 23, 2009

(65) Prior Publication Data

US 2010/0101394 A1 Apr. 29, 2010

(30) Foreign Application Priority Data

Oct. 28, 2008 (DE) ..... 10 2008 053 453

(51) Int. Cl.
*B26D 7/26* (2006.01)

(52) U.S. Cl.
USPC ..... 83/698.11; 83/698.91; 83/684

(58) Field of Classification Search
USPC ..... 83/698.11, 686, 687, 698.91, 684, 83/699.31–699.61, 691, 698.71
See application file for complete search history.

(56) References Cited

U.S. PATENT DOCUMENTS

| | | | | |
|---|---|---|---|---|
| 458,076 | A * | 8/1891 | Simmonds | 83/686 |
| 3,791,034 | A * | 2/1974 | Carver | 30/367 |
| 4,375,774 | A * | 3/1983 | Wilson et al. | 83/140 |
| 5,329,835 | A * | 7/1994 | Timp et al. | 83/686 |
| 6,276,247 | B1 * | 8/2001 | Helda | 83/684 |
| 2003/0226437 | A1 * | 12/2003 | Rosene et al. | 83/684 |

FOREIGN PATENT DOCUMENTS

| | | |
|---|---|---|
| DE | 29 48 242 A1 | 4/1981 |
| DE | 19854075 | 5/2000 |
| JP | 3042199 | 2/1991 |
| JP | 10305395 | 11/1998 |

* cited by examiner

*Primary Examiner* — Phong Nguyen
(74) *Attorney, Agent, or Firm* — Vidas, Arrett & Steinkraus, P.A.

(57) ABSTRACT

A compression punch for a rotary press, with a punch shaft that has a punch head at its one end and means for accommodating a separate punch insert at the other end, and with fastening means for detachably fastening the punch insert on the punch shaft, wherein the punch head and the punch shaft have an axial through bore, the axial through bore accommodates a drawbar that has a tensioning head at the end turned away from the punch head, said tensioning head having at least one connection portion, the punch insert has a recess at the end facing the punch shaft which is realized to be detachably connectable with the connection portion, and that tensioning means are arranged in the axial through bore, by which the drawbar can be tensioned in the direction of the punch head.

13 Claims, 3 Drawing Sheets

PUNCH FOR A ROTARY PRESS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

As is well known, a rotary press contains a plurality of upper and lower punches, which are guided in suitable guide bores of punch guidings and which co-operate with bores in a die plate. The individual punches feature a shaft, as well as a head at one end, which co-operates with compression rollers of the press. At the end turned away from the punch head is arranged a punch insert, which is realised separately and adapted to be connected with the shaft via suitable fastening means. The connection takes place with the aid of screws or pins. However, it is also known to realise compression punches in one single piece.

The known punch constructions have several disadvantages. Installation and disassembly of the punch inserts is sumptuous, and time-consuming in particular. Replacement of the punch inserts is not possible within the rotary press. The fastening of the punch inserts is susceptible to troubles and subject to high wear. Problems arise also with respect to the centring and alignment of the punch inserts, with compression moulds that are not round in particular. Finally, even the aptitude for cleaning of the known compression punches is bad, in particular if they must remain in the press (CIP=Cleaning in Place). A reason is the existence of threads, corners and seams.

The present invention is therefore based on the objective to provide a compression punch for a rotary press which ensures uncomplicated installation and disassembly of the punch insert and which permits cleaning inside the press.

BRIEF SUMMARY OF THE INVENTION

In the compression punch according to the present invention, the punch head and the punch shaft have an axial through bore, wherein the axial through bore accommodates a drawbar that has a tensioning head with at least one connection portion on that end which is turned away from the punch head. The connection portion is adapted to be brought into connection with a facing recess of the punch insert. Tensioning means are arranged in the axial through bore, by which the drawbar can be tensioned in the direction of the punch head.

In the installation, the punch insert is connected with the facing end of the drawbar, i.e. with the tensioning head. Subsequently, the drawbar is actuated in order to pull the punch insert axially against the punch shaft. According to one embodiment of the present invention, this may happen in that the drawbar has a thread, onto which a tensioning nut is screwed at the punch head side, said tensioning nut being supported by a shoulder in the axial through bore. By turning the tensioning nut, the drawbar is subjected to tensile stress, and so it can draw the punch insert against the punch shaft. Alternatively, the tensioning head may have at least one radial projection which permits insertion of the tensioning head into the recess in the one rotational position of the punch insert with respect to the drawbar, and grasps behind an undercut in the other rotational position. Instead of by a tensioning nut, the tensile stress may also be applied by a spring, which biases the drawbar into the direction of the punch head.

The connection of a punch insert with the punch shaft according to the invention makes it possible that there are only smooth surfaces of punch shaft and punch insert towards the outside. Through this results a good washability of the entire punch, because neither punch shaft nor punch insert have threads, seams or other unfavourable geometries on the outer side. Installation and disassembly of the punch insert is possible within an extremely short period of time, in fact also within the rotary press, even in an automatic way. As is well known, during their movement in the rotary press, the punches are held by cam sections in certain paths. In these stages it may then be manipulated on the punches in order to install or to remove the punch insert.

Because the punch insert is directed towards the die bore when it is installed, the tolerances of punch shaft, die bores and punch guiding may be chosen to be large. This permits significant savings in the production of the punches, dies and segments for the die plate and the punch guiding.

Near to the end of the punch insert, the outer contour of the punch insert is congruent with the outer contour of the punch shaft, so that there are no stepped transitions. The close fit of the punch insert on the facing end of the punch shaft takes preferably place via even surfaces. By way of these surfaces, a frictional fit may be achieved also, which prevents a relative rotation of the punch insert with respect to the punch shaft. Alternatively, a position pin may be provided, which is incorporated in the punch shaft and co-operates with a facing bore in the punch insert.

BRIEF DESCRIPTION OF THE SEVERAL VIEWS OF THE DRAWINGS

Examples of the realisation of the present invention are explained in more detail by means of drawings below.

DETAILED DESCRIPTION OF THE INVENTION

Figure 1:
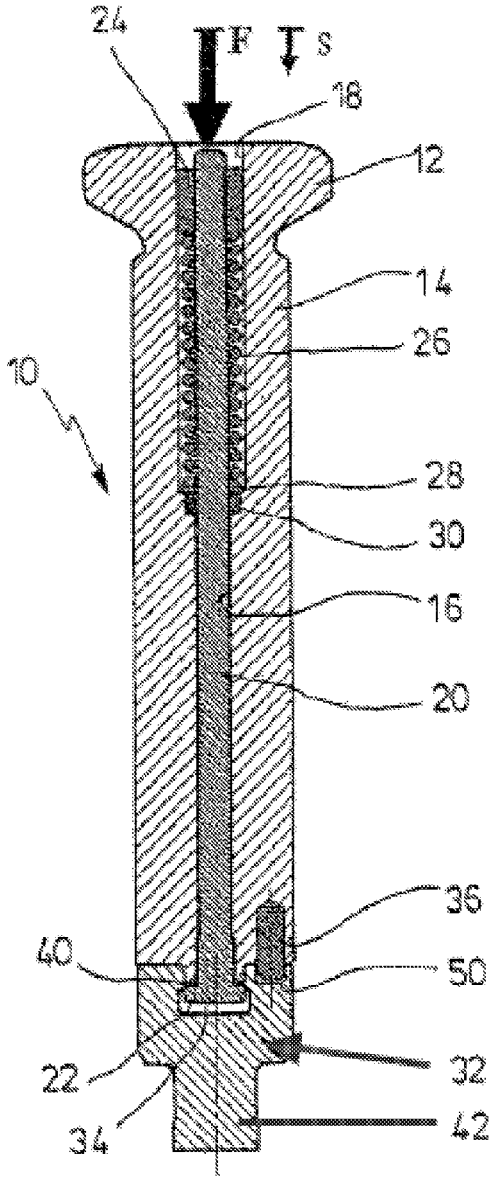
FIG. 1 shows a section through a first embodiment of a compression punch according to the present invention.

While this invention may be embodied in many different forms, there are described in detail herein a specific preferred embodiment of the invention. This description is an exemplification of the principles of the invention and is not intended to limit the invention to the particular embodiment illustrated A compression punch 10 with a punch head 12 and a punch shaft 14 is shown in FIG. 1. Punch head 12 and punch shaft 14 have a radial through bore 16. On the end facing the punch head 12, the through bore 16 has a bore portion 18 with a greater diameter. The through bore 16 accommodates a drawbar 20, which has a tensioning head 22 on its lower end. On the upper end, the drawbar 20 is provided with a thread, onto which a nut 24 is screwed up. The nut 24 serves as abutment for a helical spring 26 that is supported on a disk 28. The disk 28 is supported on the facing shoulder of the bore portion 18. An elastomer seal 30 is arranged below the disk 28. It has the purpose to prevent liquid or dust from reaching the direction of the through bore 18 from out the punch head 12.

A punch insert 32 is connected with the shaft 14 in that the tensioning head 22 engaging into a recess 34 of the punch insert 32 is biased against the facing end of the shaft 14. A position pin 36 sits in an axis parallel blind bore of the shaft 14. It co-operates with a hole 50 on the facing end of the punch insert 32. A flat seal 40, made of plastic material, sits between the tensioning head 22 and the facing end of the punch shaft 14.

Near to the punch shaft 14, the perimeter contour of the punch insert 32 is congruent with that one of the punch shaft 14, and punch shaft 14 and punch insert 32 sit close against each other via even surfaces that stand vertically to the axis of the punch 10. Due to this, there is no stepped transition towards the outside, and also no seam into which contaminations might intrude. A pressing tool 42 is formed in one piece with the punch insert 32.

Figure 3:
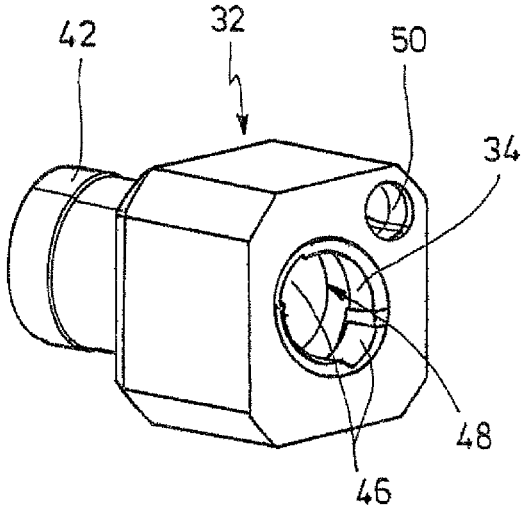
FIG. 3 shows the upper end of the punch insert after FIG. 1 in a perspective view.
Figure 4:
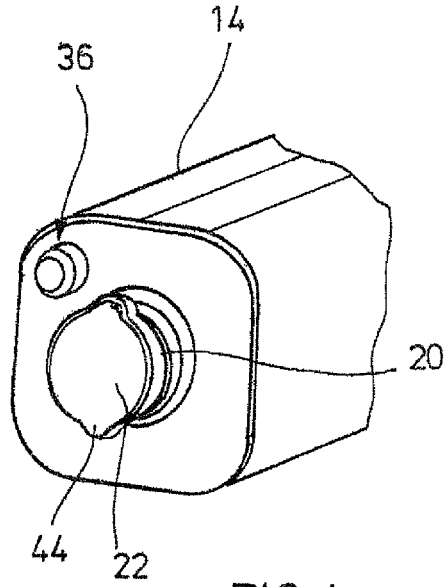
FIG. 4 shows the end facing the punch insert of the punch shaft after FIG. 1 in a perspective view.

The installation of the punch insert 32 emerges more clearly from the FIGS. 3 and 4. As emerges from FIG. 4, the tensioning head 22 has diametrically opposing projections 44. In the recess 34, the punch insert 32 has axis parallel grooves 46 that are diametrically opposed. They are adapted to accommodate the radial projections 44 when the punch insert is set against the shaft 14 and the tensioning head 22 submerges into the recess 34. Shoulders extending transversely to the axis are formed at the end of the grooves 48 by a clearance boring 48, which forms an undercut in the recess 34. A hole 50 is formed into the punch insert 32 eccentrically to the recess 50, which is formed as a long hole in the radial direction. In the perimeter direction, it is suited to accommodate the position pin 36 matingly.

In the installation of the punch insert 32 on the punch 10, the punch insert is held in such a rotational position that the radial projections 44 are directed towards the grooves 46. Then, the punch insert 32 is pushed forward against the shaft 14 until the position pin 36 hits the facing even surface of the punch insert 32. The punch insert 32 is subsequently turned about approximately 45°, by which operation the radial projections 44 or noses grasp behind the shoulders formed by the clearance bore. The rotation is performed for so long until the position pin 36 is situated over the hole 50. Subsequently, the drawbar 20 is drawn tight, so that the punch insert is tensioned against the shaft 14 of the punch 10 according to FIG. 1. In order to perform the described installation, a force is exerted on the drawbar 20 according to the arrow F in FIG. 1, so that it juts out sufficiently over the end of the shaft 14 under compression of the spring 26, so that the described installation of the punch insert 32 can be performed. For instance, this path corresponds to the path S in FIG. 1. After the installation, the force F is released, so that the spring 26 can exert its tensioning force on the punch insert 32.

Figure 2:
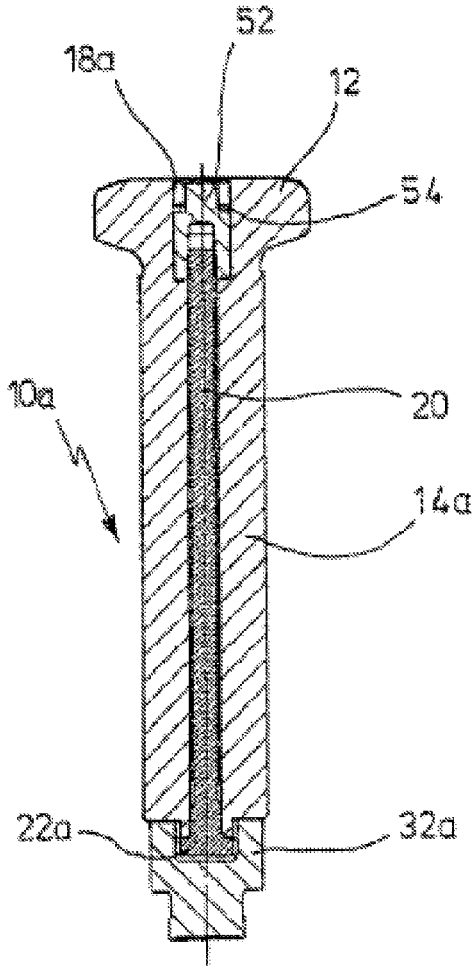
FIG. 2 shows a section through a second embodiment of a compression punch according to the present invention.

A punch 10*a* can be recognised in FIG. 2, which is essentially similar to the punch 10 in FIG. 1. It accommodates a drawbar 20*a* in a corresponding through bore, the through bore having an enlarged bore section 18*a* near to the punch head 12. A tensioning nut 52 is screwed up onto a thread of the drawbar 20*a*, so that a tensile force in the direction of the punch head 12 can be exerted on the drawbar 20*a* in order to tension a punch insert 32*a* against the punch shaft 14*a*. The connection of the tensioning head 22*a* with the punch insert 32*a* may take place in the same way as has been described for FIG. 1. The tensioning nut 52 is axially secured in the bore portion 18*a* by a locking ring 54.

Figure 5:
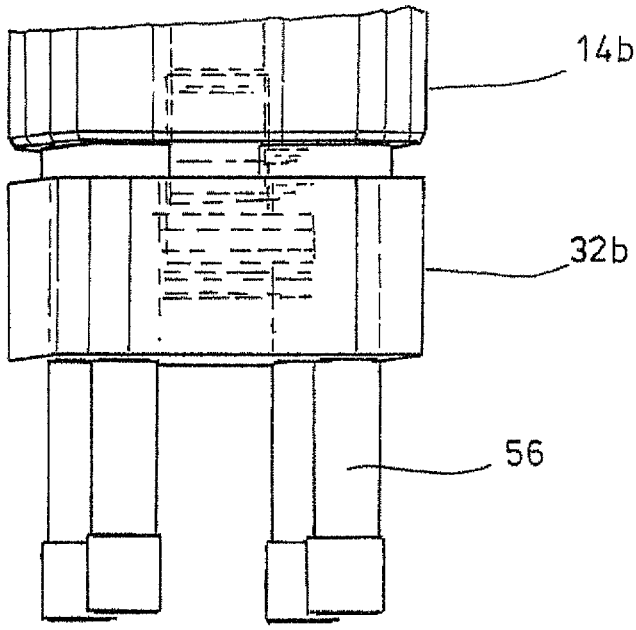
FIG. 5 shows an alternative punch insert in a perspective view.

FIG. 5 shows the lower end of a shaft 14*b* of a compression punch not shown in more detail, on which a punch insert 32*a* is fastened in a way like that described in the context of FIG. 1 to 3. Therefore, it will not be dwelled further on this connection. The particular feature of the punch insert 32*a* after FIG. 5 is that the punch insert 32*a* has four compression portions 56. In the operation, the compression portions co-operate simultaneously with four die bores.

Figure 6:
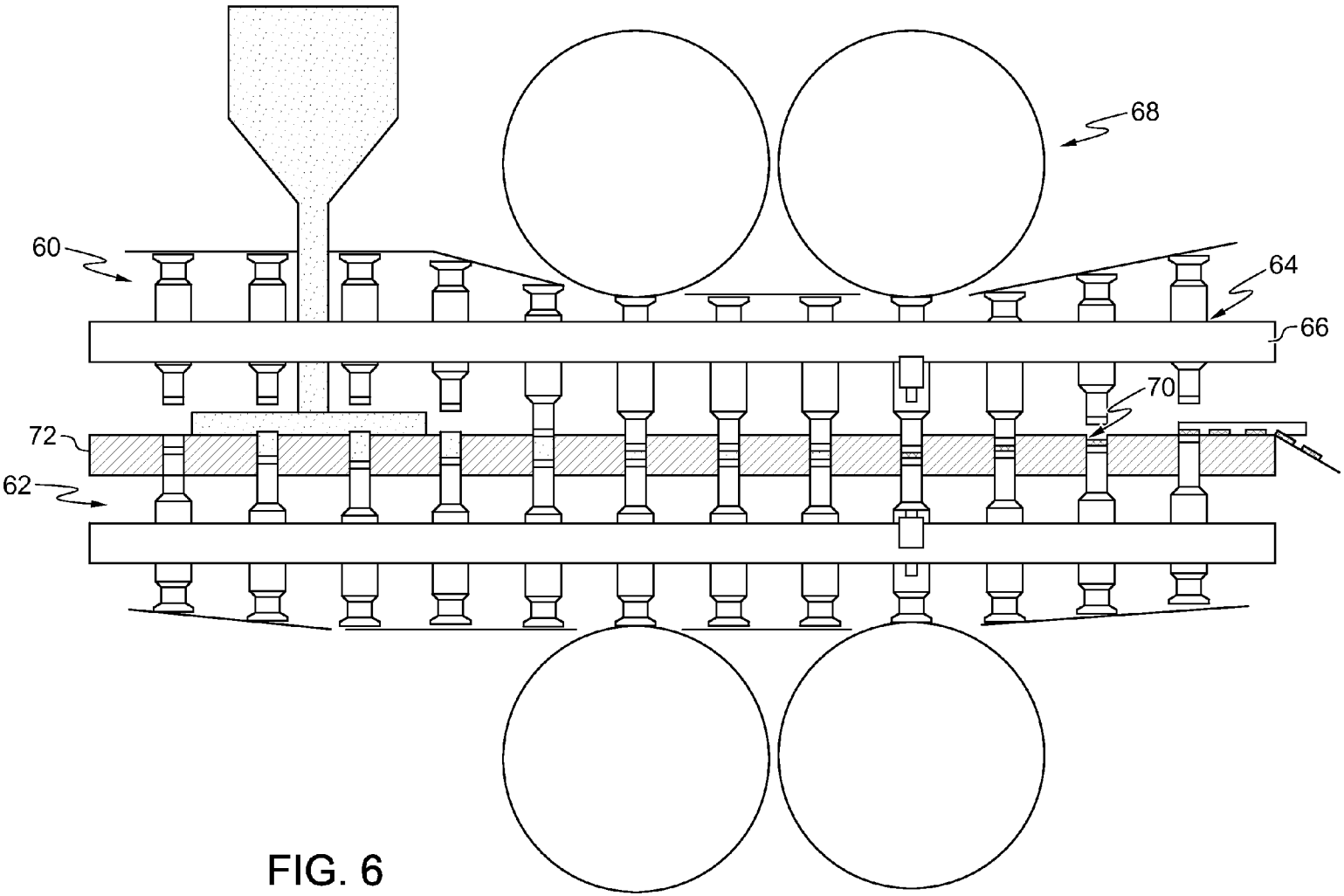
FIG. 6 shows a well know rotary press.

Referring now to FIG. 6, as is well known, a rotary press contains a plurality of upper punches 60 and lower punches 62, which are guided in suitable guide bores 64 of punch guidings 66 and which co-operate with bores 70 in a die plate 72. Compression rollers 68 compress the punches together to form the tablet.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed:

1. A compression punch for a rotary press, constructed and arranged to be guided in guide bores of punch guidings, and to cooperate with bores in a die plate of the rotary press, the compression punch with a punch shaft that has a punch head at its one end wherein the punch head cooperates with compression rollers of the rotary press and means for accommodating a separate punch insert at the other end, and with fastening means for detachably fastening the punch insert on the punch shaft, characterised in that the punch head and the punch shaft (14, 14*a*) have an axial through bore (16), the axial through bore (16) accommodates a drawbar (20, 20*a*) that has a tensioning head (22, 22*a*) at the end turned away from the punch head (12), said tensioning head having at least one connection portion, the punch insert (32, 32*a*) has a recess (34) at the end facing the punch shaft (14, 14*a*) which is realised to be detachably connectible with the connection portion, and that tensioning means are arranged in the axial through bore (16), by which the drawbar (20, 20*a*) can be tensioned in the direction of the punch head (12), and further characterised in that the tensioning head (22) has a radial extension which is greater than the radius of the axial through bore (16), the recess (34, 34*a*) is provided with an undercut such that in a first rotational position of the punch insert (32, 32*a*) with respect to the drawbar (20, 20*a*), the punch head (22, 22*a*) can be inserted into the recess (34, 34*a*), and the radial extension grasps behind the undercut in a second rotational position.

2. A compression punch according to claim 1, characterised in that the drawbar (20*a*) has a thread onto which a tensioning nut (52) is screwed at the punch head side, said tensioning nut being supported by a shoulder in an enlarged bore section (18*a*) of the axial through bore (16).

3. A compression punch according to claim 2, characterised in that the nut (52) is axially held in the bore section (18*a*) by means of a locking ring (54).

4. A compression punch according to claim 1, characterised in that a bore portion (18) near to the punch head (12) has a greater diameter than the remaining part of the through bore (20), a helical-, disk- or elastomer spring is accommodated in the bore portion (18) which is supported on a stop of the drawbar (20) at the punch head side end.

5. A compression punch according to claim 4, characterised in that the spring (26) is supported on a shoulder of the bore portion (18) via a disk (28).

6. A compression punch according to claim 5, characterised in that a seal (30) made of an elastomer is arranged between the disk (28) and the shoulder.

7. A compression punch according to claim 4, characterised in that the stop is formed by a stop nut (24), which is screwed onto a thread of the drawbar (20).

8. A compression punch according to claim 1, characterised in that the tensioning head (22) has two opposing radial projections (44) or noses and the recess (34) two axis parallel grooves (46), through which the radial projections (44) can be inserted into the recess (34), and that the undercut in the recess (34) is formed by shoulders behind which the radial projections (44) grasp.

9. A compression punch according to claim 1, characterised in that near to the end of the punch insert, the outer contour of the punch insert (32, 32*a*) is congruent with the outer contour of the punch shaft (14, 14*a*).

10. A compression punch according to claim 1, characterised in that punch shaft (14, 14*a*) and punch insert (32, 32*a*) sit close to each other via even surfaces.

11. A compression punch according to claim 1, characterised in that the end of the punch shaft (14, 14*a*) turned away from the punch head (12) has eccentrically a position bore for accommodating a position pin (36), and the punch insert (32) has a hole (50) which accommodates the end of the position pin projecting out of the bore of the punch shaft.

12. A compression punch according to claim 11, characterised in that the hole (50) is realised as a long hole in the radial direction.

13. A compression punch according to claim 1, characterised in that the punch insert (32*b*) is provided with several parallel punch portions (56).

* * * * *